US009543641B2

(12) United States Patent
Tsutsumi

(10) Patent No.: US 9,543,641 B2
(45) Date of Patent: Jan. 10, 2017

(54) WIRELESS APPARATUS

(75) Inventor: Yukako Tsutsumi, Kawasaki (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 484 days.

(21) Appl. No.: 13/477,464

(22) Filed: May 22, 2012

(65) Prior Publication Data

US 2013/0016015 A1 Jan. 17, 2013

(30) Foreign Application Priority Data

Jul. 13, 2011 (JP) ..... 2011-155126

(51) Int. Cl.
*H01Q 1/38* (2006.01)
*H01Q 1/22* (2006.01)
*H01Q 1/52* (2006.01)

(52) U.S. Cl.
CPC ..... *H01Q 1/38* (2013.01); *H01Q 1/2283* (2013.01); *H01Q 1/528* (2013.01)

(58) Field of Classification Search
USPC ..... 343/700 MS, 702, 851
See application file for complete search history.

(56) References Cited

U.S. PATENT DOCUMENTS 2,283,914 A 5/1942 Carter
4,623,893 A 11/1986 Sabban
5,276,455 A 1/1994 Fitzsimmons et al.
5,404,581 A 4/1995 Honjo
5,422,650 A 6/1995 Hill
5,488,380 A 1/1996 Harvey et al.
5,682,143 A 10/1997 Brady et al.
5,786,626 A 7/1998 Brady et al.
5,903,239 A 5/1999 Takahashi et al.
5,972,156 A 10/1999 Brady et al.
6,078,259 A 6/2000 Brady et al.
6,137,453 A 10/2000 Wang et al.
6,181,278 B1 1/2001 Kakimoto et al.
6,249,242 B1 6/2001 Sekine et al.
(Continued)

FOREIGN PATENT DOCUMENTS

JP 5-327329 A 12/1993
JP 8-088581 A 4/1996
(Continued)

OTHER PUBLICATIONS

Related U.S. Appl. No. 13/178,967, filed Jul. 8, 2011; Yukako Tsutsumi; Radio Device.
(Continued)

*Primary Examiner* — Hoang V Nguyen
*Assistant Examiner* — Hai Tran
(74) *Attorney, Agent, or Firm* — Holtz, Holtz & Volek PC

(57) ABSTRACT

According to one embodiment, a wireless apparatus includes a mounting board, a semiconductor package and a first layer. The mounting board has a first surface and a second surface opposite to the first surface. The semiconductor package comprises at least one antenna and is mounted on the first surface. The first layer is a conductor formed on the second surface or between the first surface and the second surface, at least one portion of an edge of the first layer being concaved if the antenna is arranged closer to the edge than the center of the first layer when seen in thickness direction of the mounting board.

16 Claims, 11 Drawing Sheets

(56) References Cited

U.S. PATENT DOCUMENTS

| | | | | |
|---|---|---|---|---|
| 6,271,793 | B1 | 8/2001 | Brady et al. | |
| 6,662,430 | B2 | 12/2003 | Brady et al. | |
| 6,717,544 | B2 | 4/2004 | Nagasaku et al. | |
| 6,770,955 | B1 * | 8/2004 | Coccioli | H01L 23/3128 257/659 |
| 6,833,806 | B2 | 12/2004 | Nagasaku et al. | |
| 6,906,677 | B2 * | 6/2005 | Yamamoto | H01Q 1/007 343/700 MS |
| 7,088,896 | B2 | 8/2006 | Andrieu et al. | |
| 7,119,745 | B2 * | 10/2006 | Gaucher | H01Q 9/26 343/700 MS |
| 7,154,432 | B2 | 12/2006 | Nagasaku et al. | |
| 7,295,161 | B2 | 11/2007 | Gaucher et al. | |
| 7,329,950 | B2 | 2/2008 | Khorram | |
| 7,382,331 | B2 | 6/2008 | Kurashima et al. | |
| 7,518,221 | B2 | 4/2009 | Gaucher et al. | |
| 7,545,329 | B2 | 6/2009 | Gaucher et al. | |
| 7,559,131 | B2 | 7/2009 | Credelle et al. | |
| 7,580,001 | B2 | 8/2009 | Tsai et al. | |
| 7,586,193 | B2 | 9/2009 | Weste | |
| 7,595,766 | B2 | 9/2009 | Rofougaran | |
| 7,619,529 | B2 | 11/2009 | Goff et al. | |
| 7,656,030 | B2 | 2/2010 | Osone et al. | |
| 7,768,456 | B2 * | 8/2010 | Tsutsumi | H01L 23/66 343/700 MS |
| 7,782,624 | B2 | 8/2010 | Fujii | |
| 7,971,791 | B2 | 7/2011 | Nishizawa et al. | |
| 8,123,131 | B2 | 2/2012 | Sawachi | |
| 8,330,259 | B2 | 12/2012 | Soler Castany et al. | |
| 2004/0066336 | A1 | 4/2004 | De Graauw | |
| 2005/0169544 | A1 | 8/2005 | Clark | |
| 2006/0033664 | A1 | 2/2006 | Soler Castany et al. | |
| 2006/0151614 | A1 | 7/2006 | Nishizawa et al. | |
| 2006/0256018 | A1 | 11/2006 | Soler Castany et al. | |
| 2007/0120742 | A1 | 5/2007 | Soler Castany et al. | |
| 2007/0194427 | A1 | 8/2007 | Choi et al. | |
| 2007/0200708 | A1 | 8/2007 | Hayama et al. | |
| 2007/0235864 | A1 | 10/2007 | Megahed | |
| 2007/0273600 | A1 | 11/2007 | Tsujimura et al. | |
| 2008/0158091 | A1 | 7/2008 | Imaoka et al. | |
| 2008/0158094 | A1 | 7/2008 | Rofougaran | |
| 2008/0231518 | A1 * | 9/2008 | Tsutsumi | H01L 23/66 343/700 MS |
| 2009/0015485 | A1 | 1/2009 | Floyd et al. | |
| 2009/0085810 | A1 | 4/2009 | Soler Castany et al. | |
| 2010/0190464 | A1 | 7/2010 | Chen et al. | |
| 2011/0309893 | A1 | 12/2011 | Kawamura et al. | |
| 2012/0075147 | A1 | 3/2012 | Tsutsumi et al. | |
| 2012/0193810 | A1 | 8/2012 | Tsutsumi et al. | |
| 2012/0249380 | A1 | 10/2012 | Soler Castany et al. | |
| 2012/0319913 | A1 | 12/2012 | Tsutsumi et al. | |
| 2013/0016029 | A1 | 1/2013 | Tsutsumi | |

FOREIGN PATENT DOCUMENTS

| | | | |
|---|---|---|---|
| JP | 8-213419 | A | 8/1996 |
| JP | 10-013296 | A | 1/1998 |
| JP | 11-261456 | A | 9/1999 |
| JP | 2000-174543 | A | 6/2000 |
| JP | 2001-196824 | A | 7/2001 |
| JP | 2001-203519 | A | 7/2001 |
| JP | 2001196829 | A | 7/2001 |
| JP | 2005-228226 | A | 8/2005 |
| JP | 2006-505973 | A | 2/2006 |
| JP | 2007-267217 | A | 10/2007 |
| JP | 2007-300266 | A | 11/2007 |
| JP | 2007-312354 | A | 11/2007 |
| JP | 2008-028691 | A | 2/2008 |
| JP | 2008-035033 | A | 2/2008 |
| JP | 2008-141215 | A | 6/2008 |
| JP | 2008131215 | A | 6/2008 |
| JP | 2008-167036 | A | 7/2008 |
| JP | 4121860 | B2 | 7/2008 |
| JP | 2008160949 | A | 7/2008 |
| JP | 2008-259250 | A | 10/2008 |
| JP | 2010-021456 | A | 1/2010 |
| JP | 2010-109466 | A | 5/2010 |
| JP | 2010-183055 | A | 8/2010 |
| JP | 4523223 | B2 | 8/2010 |
| JP | 2011-130254 | A | 6/2011 |
| JP | 2012070253 | A | 4/2012 |
| WO | WO 96/13793 | A1 | 5/1996 |
| WO | WO 2004/042868 | A1 | 5/2004 |

OTHER PUBLICATIONS

U.S. Appl. No. 13/344,848; First Named Inventor: Yukako Tsutsumi; Title: "Wireless Apparatus and Wireless System"; filed Jan. 6, 2012.

U.S. Appl. No. 13/447,676; First Named Inventor: Yukako Tsutsumi; Title: "Wireless Apparatus"; filed Apr. 16, 2012.

U.S. Appl. No. 13/542,149; First Named Inventor: Yukako Tsutsumi; filed Jul. 5, 2012; Title: "Antenna Device and Wireless Apparatus".

U.S. Appl. No. 13/782,552; First Named Inventor: Yukako Tsutsumi; Title: "Wireless Device"; filed Mar. 1, 2013.

* cited by examiner

WIRELESS APPARATUS

CROSS-REFERENCE TO RELATED APPLICATIONS

This application is based upon and claims the benefit of priority from prior Japanese Patent Application No. 2011-155126, filed Jul. 13, 2011, the entire contents of which are incorporated herein by reference.

FIELD

Embodiments described herein relate generally to a wireless apparatus.

BACKGROUND

There is a method for providing, as a semiconductor package with built-in antenna, a metal plate functioning as a radiator connected with a semiconductor chip on a board within a semiconductor package, and providing a metal plate functioning as a reflector parallel to the radiator, thereby preventing from being radiated in different directions, and can be radiated in a desired direction.

DETAILED DESCRIPTION

Figure 1A:
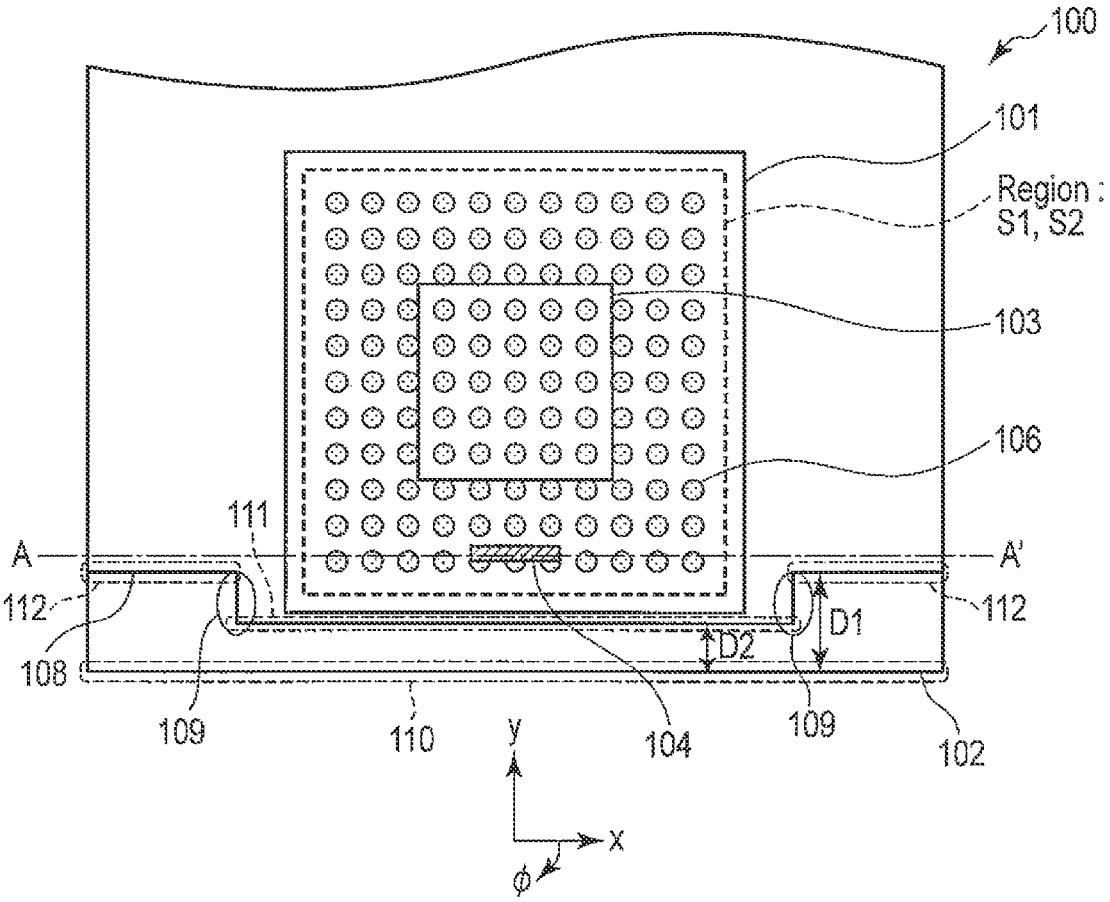
FIG. 1A is a plan view illustrating a wireless apparatus according to the first embodiment.

A semiconductor package is used, mounted on a board. In this case, if a conventional semiconductor package with built-in antenna is mounted on a board on which a metal plate has been formed, a current is induced in the metal plate near the antenna, thereby degrading the antenna characteristics.

The thickness of a board on which a semiconductor package with an antenna is mounted changes depending on a system and the like. By making the board sufficiently thick, and removing a metal plate on the board near the antenna, it is possible to reduce an influence on the antenna. On the other hand, if a board is thin and a metal plate exists under the board, or if it is necessary to arrange the terminals of a semiconductor package, a ground, and a metal plate such as wiring lines near the antenna, they exert an influence on the antenna, thereby changing the antenna characteristics.

A conventional semiconductor package with built-in antenna is a dipole antenna with a reflector and a metal plate existing near the antenna has an influence on it. Since the influence of the metal plate of the board is not considered, a problem arises in implementation.

In general, according to one embodiment, a wireless apparatus includes a mounting board, a semiconductor package and a first layer. The mounting board has a first surface and a second surface opposite to the first surface. The semiconductor package includes at least one antenna and is mounted on the first surface. The first layer is a conductor formed on the second surface or between the first surface and the second surface, at least one portion of an edge of the first layer being concaved wherein the antenna is arranged closer to the edge than the center of the first layer when seen in thickness direction of the mounting board.

A wireless apparatus according to an embodiment of the present embodiments will be described in detail below with reference to the accompanying drawings. Note that in the following embodiments, parts with the same reference numerals perform the same operation, and a repetitive description thereof will be omitted.

(First Embodiment)

Figure 1B:
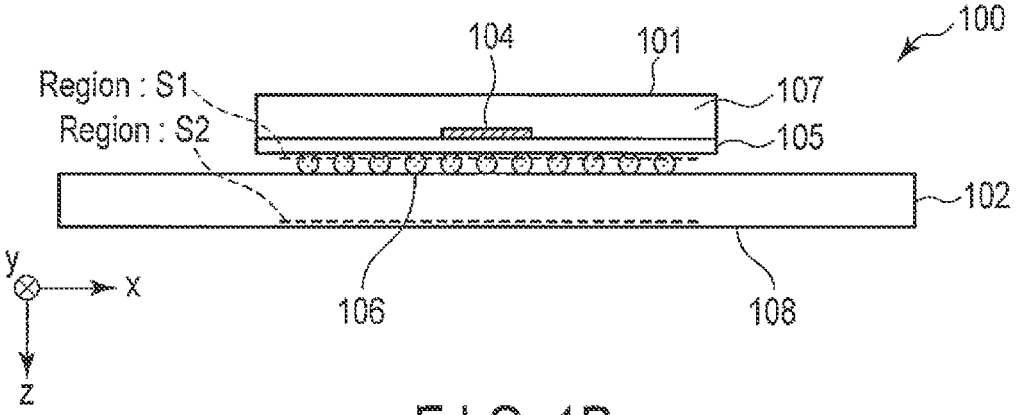
FIG. 1B is a sectional view illustrating the wireless apparatus according to the first embodiment.

A wireless apparatus according to the first embodiment will be described with reference to FIGS. 1A and 1B. FIG. 1A is a perspective view illustrating a wireless apparatus when seen from the z-axis direction. FIG. 1B is a sectional view taken along a line A-A' in FIG. 1A and illustrating the wireless apparatus when seen from the y-axis direction.

A wireless apparatus 100 according to the first embodiment includes a semiconductor package 101 and a mounting board 102. The semiconductor package 101 includes a semiconductor chip 103, an antenna 104, a board 105, package terminals 106, and an encapsulation resin 107. The mounting board 102 includes a metal plate 108.

The mounting board 102 is a board on which the semiconductor package 101 is mounted and connected. In addition to the semiconductor package 101, other components are also connected with the mounting board 102.

The semiconductor chip 103 is obtained by forming a metal plate with copper, aluminum, gold, or the like in the interior or on the surface of the semiconductor board made of, for example, silicon, silicon germanium, gallium arsenide, or the like. Note that the semiconductor chip 103 may be made of a dielectric substrate, magnetic substrate, metal, or a combination thereof. The semiconductor chip 103 is square in FIGS. 1A and 1B. The shape, however, is not limited to a square, and may be a rectangular shape, a polygonal shape other than a rectangular shape, a circular shape, or another complex shape. Although there is one semiconductor chip 103 in the example of FIGS. 1A and 1B, a plurality of semiconductor chips may exist and may be stacked or arranged in parallel.

The antenna 104 may be formed by a metal plate on the board 105 or the semiconductor chip 103 within the semiconductor package 101. Alternatively, the antenna 104 may be formed by combining the metal plate on the semiconductor chip 103 or board 105 with a boding wire, a bump, a dielectric board (not shown), or the like. In this embodiment, the antenna 104 is assumed to be arranged closer to the outermost edge 110 of the mounting board 102 than the center of the semiconductor package 101. Note that the antenna 104 has a symmetrical shape in the example of FIGS. 1A and 1B. The present embodiment, however, is not limited to this. The antenna 104 may have an asymmetrical shape, and may be a dipole antenna, an inverted-F antenna, a patch antenna, a Yagi antenna, a dielectric antenna, or another antenna.

The board 105 is an interposer board mounting the semiconductor chip 103, which electrically connects, by means of soldering or the like, the semiconductor chip 103 with the mounting board 102 through the package terminals 106 formed on the board 105.

The package terminals 106 are, for example, solder balls, which electrically connect the semiconductor package 101 with the mounting board 102.

The sealing agent encapsulation resin 107 is made of, for example, a thermosetting molding compound obtained by adding a silica filler or the like to an epoxy resin as a major component, and is filled in the semiconductor package 101 to protect the semiconductor.

The metal plate 108 is a conductor, and is a layer formed on a second surface of the mounting board 102 on the opposite side of its first surface on which the semiconductor package 101 is mounted. Note that in this embodiment, the metal plate 108 is provided on the second surface, that is, the lowest layer of the mounting board 102. The present embodiment, however, is not limited to this. The metal plate 108 may be provided on the internal layer of the mounting board 102, or a plurality of metal plates 108 may be provided. As shown in FIG. 1B, a second region S2, which a first region S1 is orthogonally projected onto the metal plate 108, of the metal plate is formed by conductor at least. The first region S1 is a region occupied by package terminals 106.

With above-described arrangement, the package terminals 106 can be connected to the metal plate 108 of the mounting board 102 by vias (not shown) with a shortest path without routing wiring lines, thereby decreasing a parasitic capacity due to connection and enhancing a power supply and ground.

At portions outside the second region S2 of the metal plate 108, the metal plate 108 has concaves (to be referred to as notches 109 hereinafter) respectively at both sides of the antenna 104 when seen from the z-axis direction, along a first edge of the metal plate 108 to which the antenna is close. That is, as shown in FIG. 1A, the notch 109 is set so that the distance (D1) between the outermost edge 110 of the mounting board 102 and a third edge 112 of the metal plate 108 is longer than the distance (D2) between the outermost edge 110 of the mounting board 102 and a second edge 111 of the metal plate 108. This means that the first edge of the metal plate 108 includes the second edge 111 and the third edge 112. Note that the distance D2 of the embodiment may be zero. That is, the second edge 111 of the metal plate 108 may exist at the same position as that of the outermost edge 110 of the mounting board 102 when seen from the z-axis direction.

Note that it is desirable to form the metal plate 108 as a ground pattern or power supply pattern occupying a relatively wide region since the metal plate 108 includes the region S2. The metal plate 108 may be formed as a floating metal pattern.

Furthermore, in this embodiment, a case in which the metal plate 108 is rectangular or square is exemplified. The shape, however, is not limited to them, and may be a polygon, circle, ellipse, or any other shapes. If, for example, the metal plate 108 is circular, the metal plate 108 need only have a concave at a portion of its edge to which the antenna 104 is close.

A result of comparing the wireless apparatus 100 according to the first embodiment with a conventional apparatus including no notch will now be described.

Figure 2A:
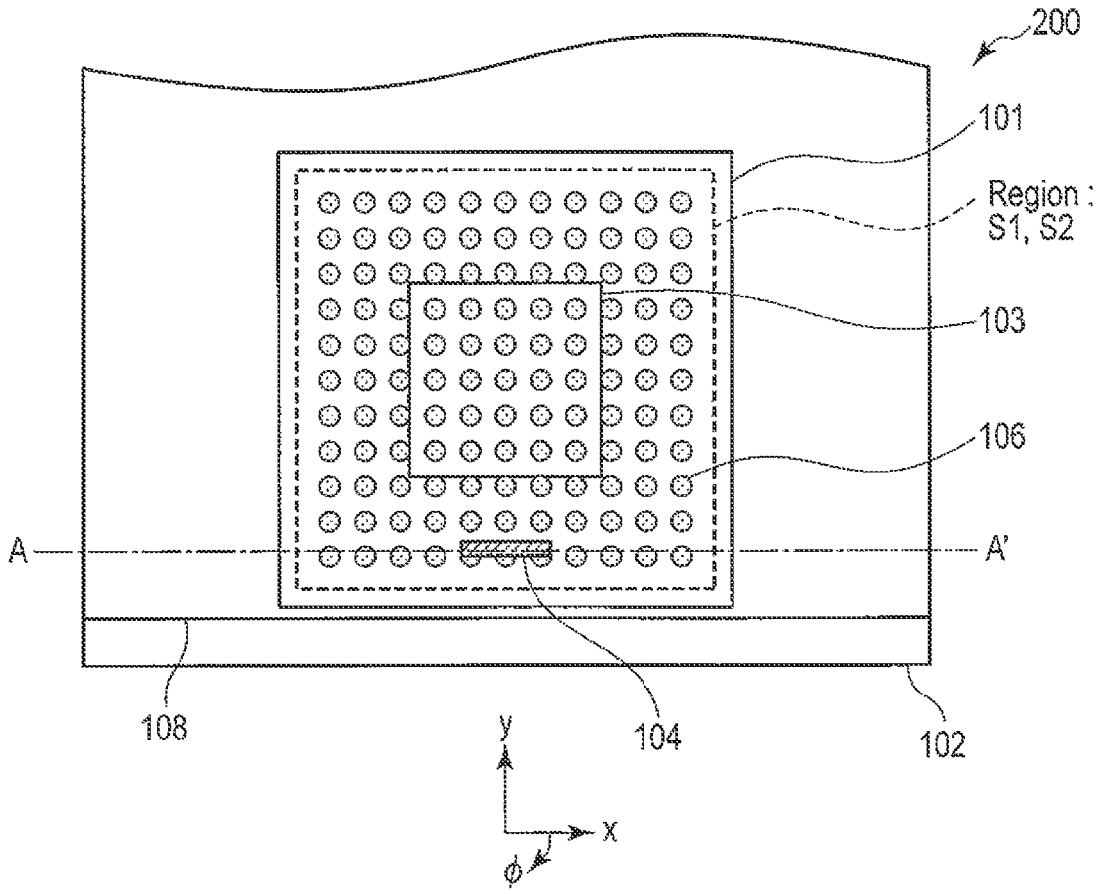
FIG. 2A is a plan view illustrating a conventional apparatus.
Figure 2B:
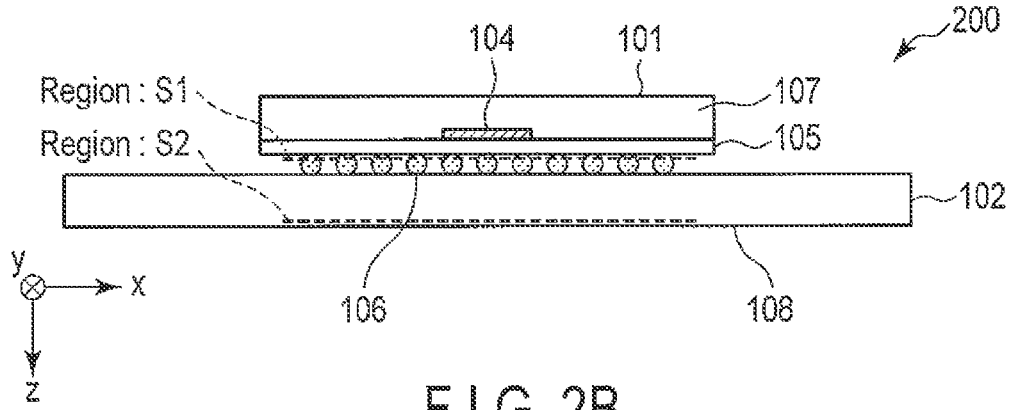
FIG. 2B is a sectional view illustrating the conventional apparatus.

FIGS. 2A and 2B illustrate a typical conventional apparatus including no notch. FIG. 2A is a view illustrating the conventional apparatus when seen from the z-axis direction. FIG. 2B is a sectional view taken along a line A-A' in FIG. 2A and illustrating the conventional apparatus when seen from the y-axis direction.

As illustrated in FIG. 2A, the metal plate 108 of a conventional apparatus 200 has no notch, and the outermost edge of the metal plate 108 which is close to the antenna 104 is straight.

Figure 3:
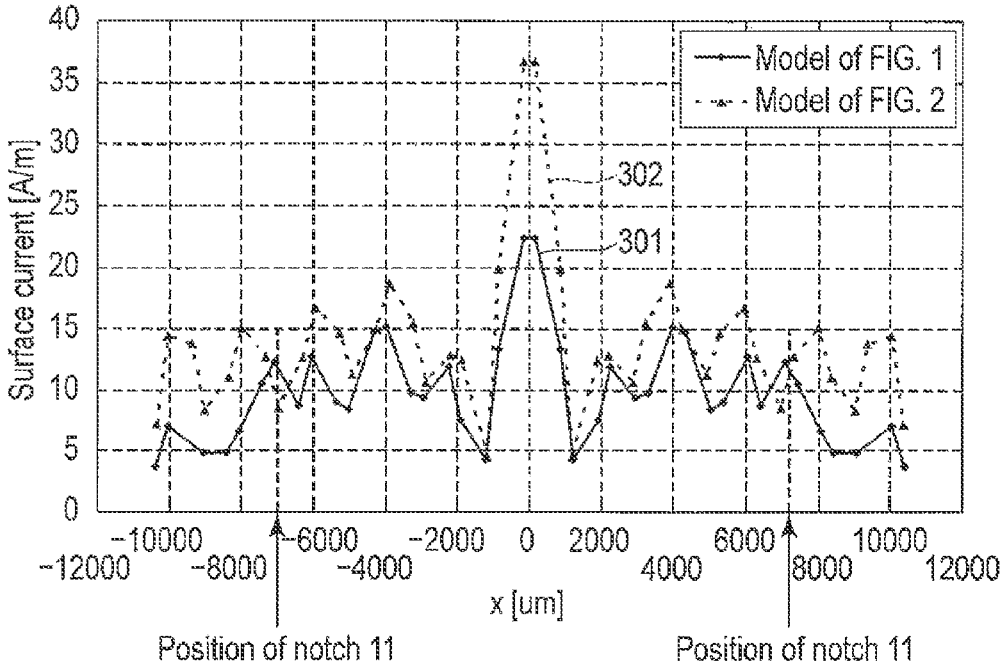
FIG. 3 is a graph illustrating the simulation results of the current values.

FIG. 3 illustrates the electromagnetic field simulation results of current intensity on the edge of the metal plate 108 which is parallel to and closest to the first edge of the mounting board 102 using models of the wireless apparatus 100 illustrated in FIG. 1 and the conventional apparatus 200 illustrated in FIG. 2. The vertical axis represents surface current intensity, and the horizontal axis represents a position on the edge of the metal plate 108 along the x-axis.

A graph 301 represents the simulation result of the wireless apparatus 100 according to the first embodiment. A graph 302 represents the simulation result of the conventional apparatus 200. As shown in FIG. 3, at positions which are outer sides than the notches, the current intensity of the graph 301 is smaller than that of the graph 302, which means that the current is suppressed at these positions.

Figure 4A:
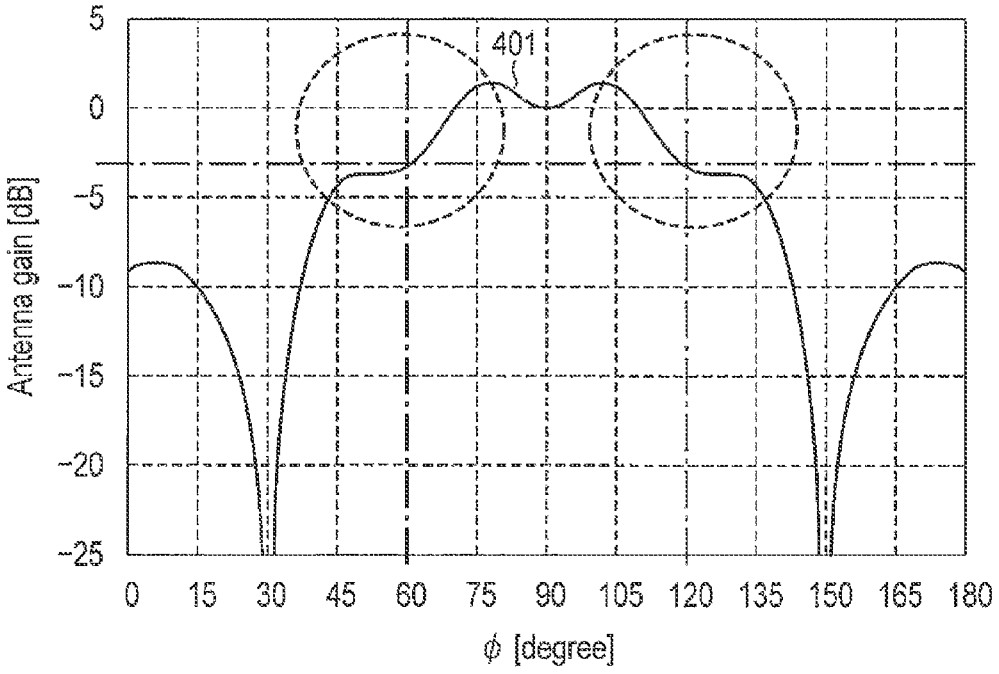
FIG. 4A is a graph illustrating the simulation result of the radiation pattern of the conventional apparatus.
Figure 4B:
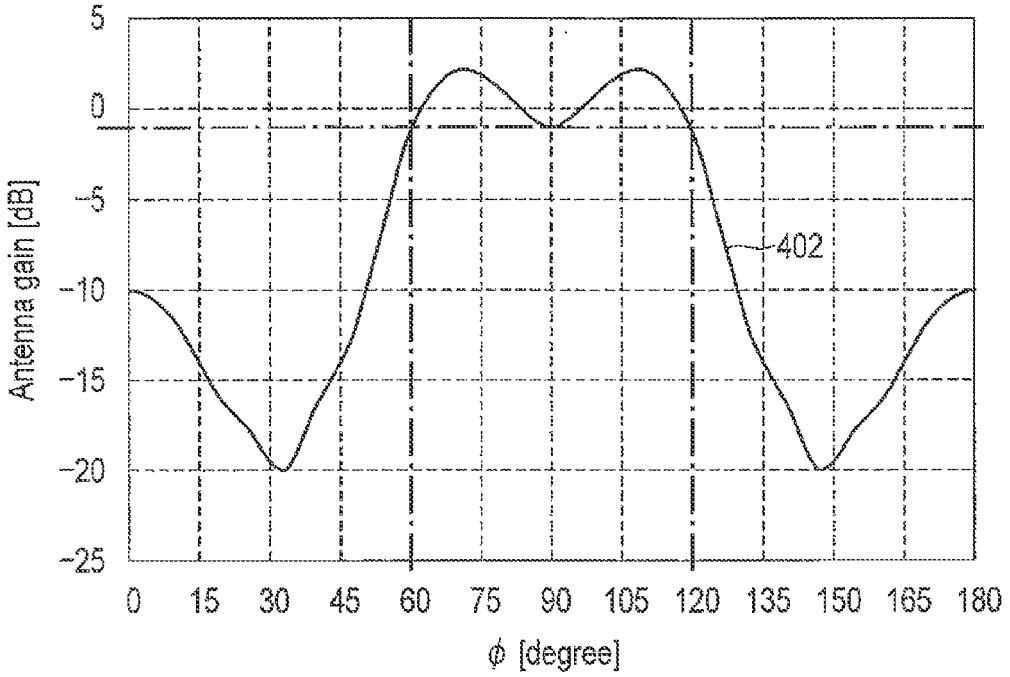
FIG. 4B is a graph illustrating the simulation result of the radiation pattern of the wireless apparatus according to the first embodiment.

FIGS. 4A and 4B respectively illustrate the simulation results of the radiation patterns on the x-y planes of the conventional apparatus 200 and the wireless apparatus 100 according to the first embodiment. FIG. 4A illustrates the simulation result of the radiation pattern of the conventional apparatus 200. FIG. 4B illustrates the simulation result of the radiation pattern of the wireless apparatus 100. The vertical axis represents an antenna gain, and the horizontal axis represents a radiation angle. An angle of 0° on the horizontal axis indicates the +x-axis direction, and an angle of 90° on the horizontal axis indicates the −y-axis direction.

As represented by a graph 401 of FIG. 4A, in the conventional apparatus 200, unwanted ripples occur in regions within circles drawn by broken lines. On the other hand, in a graph 402 representing the radiation pattern of the wireless apparatus 100 shown in FIG. 4B, ripples are reduced as compared with the radiation pattern of the conventional apparatus 200, and the characteristics improve. An antenna gain within the range from an angle $\phi$ of 60° to 120° is −3.2 dBi or larger in the conventional apparatus 200 but a high gain like −1.3 dBi or larger is obtained in a wide angle in the wireless apparatus 100.

In the semiconductor package 101 as illustrated in FIGS. 1A and 1B and FIGS. 2A and 2B, the current is induced in the metal plate 108 by the current flowing through the antenna 104. Furthermore, when the antenna 104 comes closer to the outermost edge of the metal plate 108, the current is more significantly induced. The current flowing through the metal plate 108 causes a ripple in the radiation pattern of the antenna 104, and causes a change in radiation angle (beam width).

If the antenna 104 is arranged closer to the outermost edge 110 of the mounting board 102 than the center of the semiconductor package 101, that is, closer to the outermost edge (first edge) of the metal plate 108 than its center, notches are provided on the outermost edge of the metal plate 108 like the wireless apparatus 100 according to the embodiment. This can decrease the current flowing through a portion outside the notches of the metal plate 108 from the viewpoint of the antenna 104. Furthermore, adjusting the positions of the notches can change the radiation pattern of the antenna 104, thereby improving the antenna characteristics to a desired level. The notches need only be provided at a portion outside the second region S2 on the metal plate 108. However, as the notches are provided closer to the antenna, it is possible to decrease a current more. Thus, the notches are desirably provided near the second region S2.

Comparison of the intensity of current induced in the metal plate 108 for various notches will be described with reference to FIG. 5.

Figure 5:
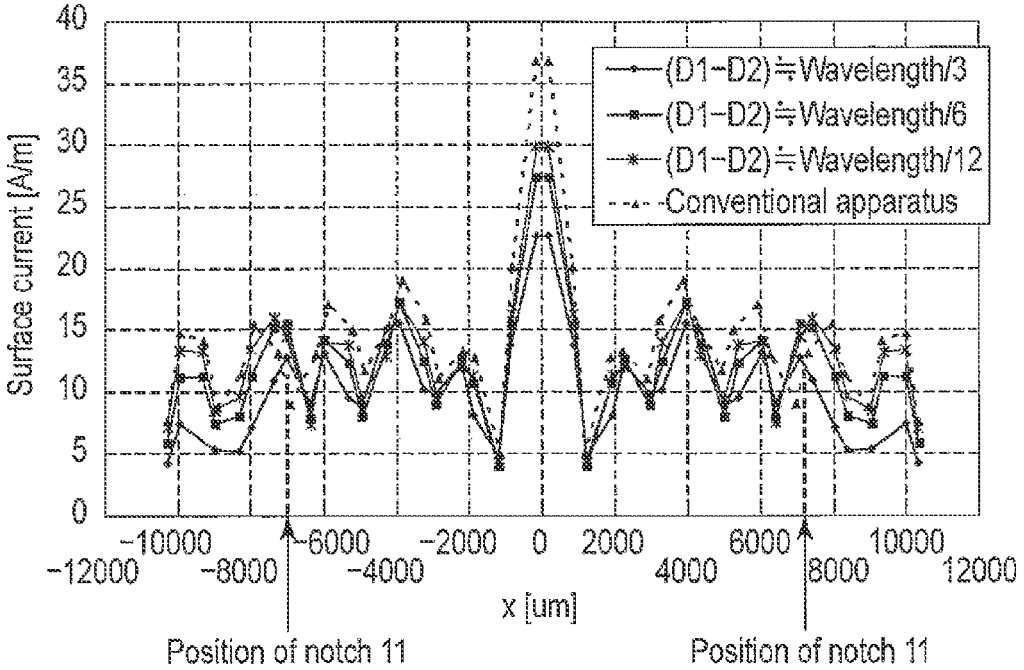
FIG. 5 is a graph illustrating a comparison of the values of currents induced in a metal plate for various notches.

FIG. 5 illustrates the electromagnetic field simulation results of the intensity of current induced on the outermost edge of the metal plate 108 for various notch depths to the second edge 111. For comparison, FIG. 5 also illustrates the simulation result of the current intensity when no notch is provided for the metal plate like the conventional apparatus 200.

As shown in FIG. 5, if a distance of the difference (to also be referred to as a depth) between the distances D1 and D2 is a 1/12 wavelength, the current induced in the metal plate 108 outside the notches from the viewpoint of the antenna 104 (at a position of 7000 μm or larger and a position of −7000 μm or smaller which are indicated by arrows in FIG. 5) are suppressed as compared with the conventional apparatus 200 which has no notch.

Furthermore, if the difference between the distances D1 and D2 is a 1/6 or 1/3 wavelength, a decrease in current is larger. Making the difference between the distances D1 and D2 at least 1/12 wavelength or longer can suppress currents induced in the metal plate 108 outside the notches, thereby further improving the antenna characteristics.

(First Modification)

A wireless apparatus according to the first modification to the first embodiment will be described with reference to FIGS. 6A and 6B.

Figure 6A:
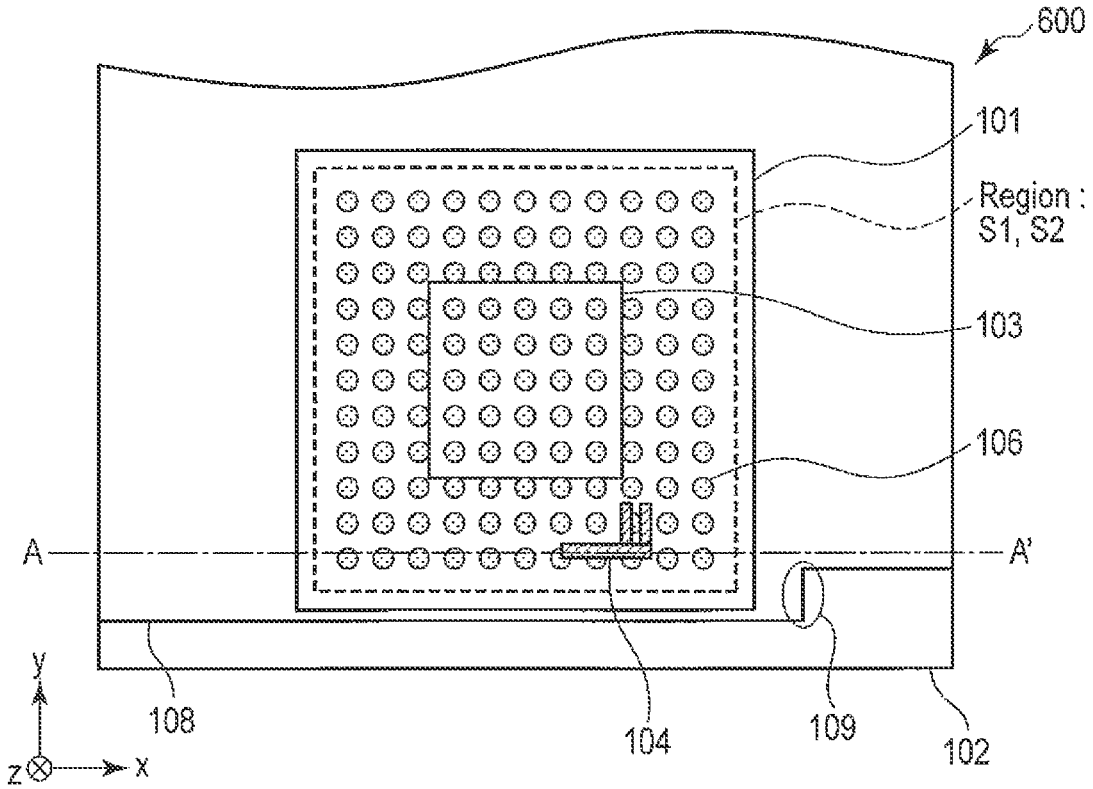
FIG. 6A is a plan view illustrating a wireless apparatus according to the first modification.
Figure 6B:
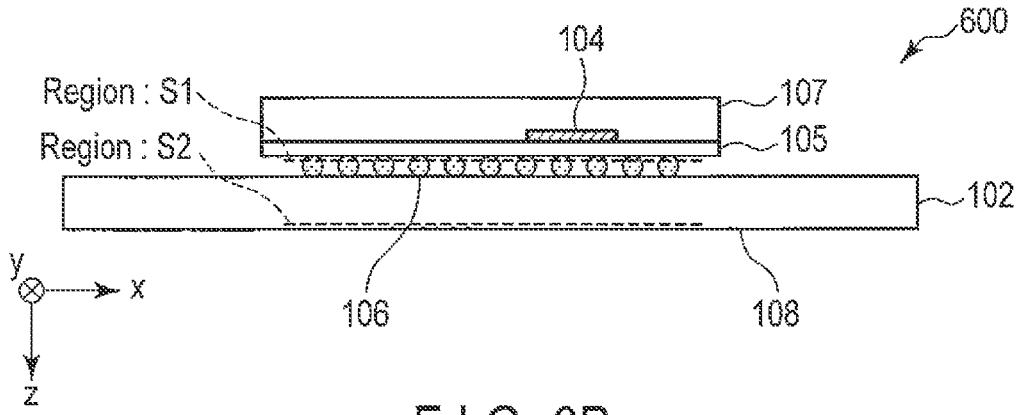
FIG. 6B is a sectional view illustrating the wireless apparatus according to the first modification.

FIG. 6A is a plan view illustrating a wireless apparatus when seen from the z-axis direction. FIG. 6B is a sectional view taken along a line A-A' in FIG. 6A and illustrating the wireless apparatus when seen from the y-axis direction.

The wireless apparatus 600 according to the first modification is almost the same as that in the first embodiment. A different point is that the antenna 104 is an inverted-F antenna and one notch is provided for the metal plate 108. Providing one notch can improve the degree of freedom of the shape of the metal plate 108 while suppressing an undesired current.

(Second Modification)

Figure 7:
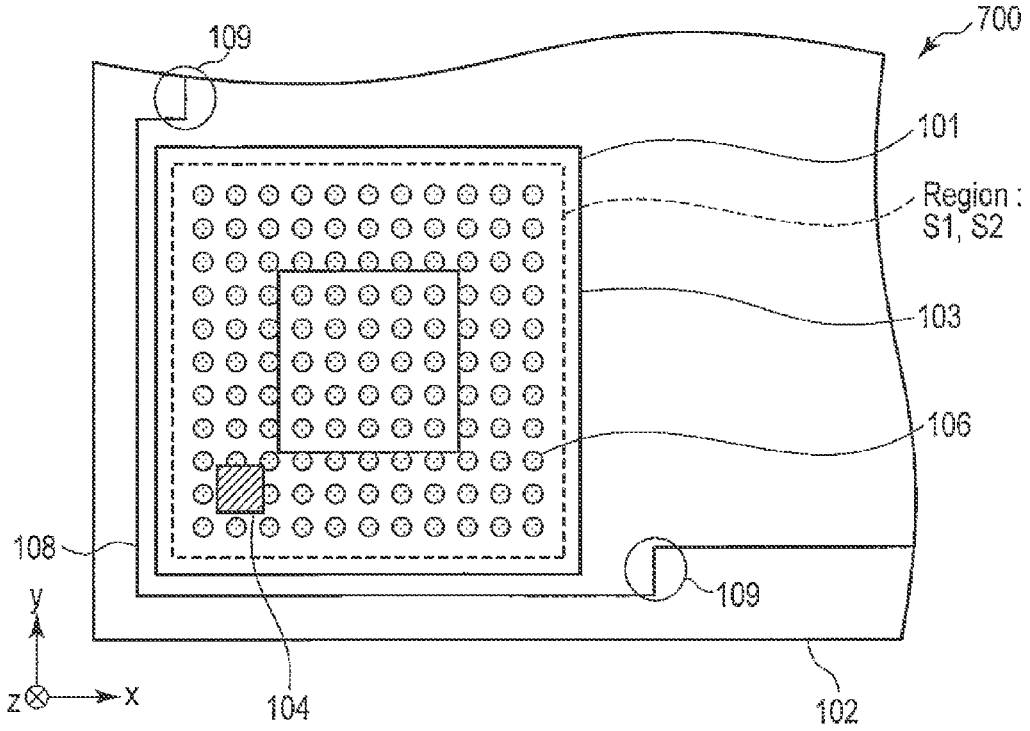
FIG. 7 is a view illustrating a wireless apparatus according to the second modification.

A wireless apparatus according to the second modification to the first embodiment will be described with reference to FIG. 7. FIG. 7 is a plan view illustrating a wireless apparatus when seen from the z-axis direction.

A wireless apparatus 700 according to the second modification has almost the same arrangement as that in the first embodiment. A different point is that the semiconductor package 101 is arranged at a corner of the mounting board 102. Arranging the semiconductor package 101 at a corner of the mounting board 102 enables efficient radiation from the antenna toward the corner as compared with a case in which the semiconductor package 101 is arranged at the center of the mounting board 102. In the example shown in FIG. 7, the antenna 104 is close to two edges of the metal plate 108, and therefore, notches 109 may be provided on each of the edges or a notch 109 may be provided on one of the edges.

(Third Modification)

Figure 8:
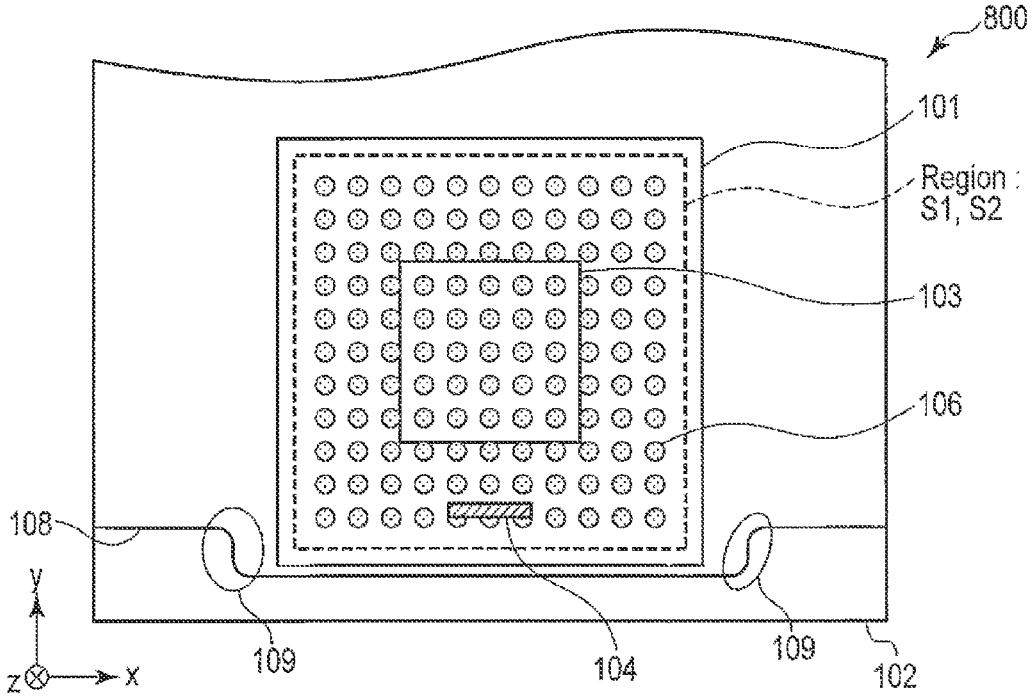
FIG. 8 is a view illustrating a wireless apparatus according to the third modification.

A wireless apparatus according to the third modification to the first embodiment will be described with reference to FIG. 8. FIG. 8 is a plan view illustrating a wireless apparatus when seen from the z-axis direction.

A wireless apparatus 800 according to the third modification has almost the same arrangement as that in the first embodiment. A different point is that the notches have not right-angled corners but rounded corners. Even if the notches are formed to have rounded corners, it is possible to suppress the current induced outside the notches and to improve the antenna characteristics, similarly to the wireless apparatus 100 according to the first embodiment.

Note that the mounting board of the wireless apparatus has been described on the assumption that the mounting board is a rectangle larger than the metal plate, but it may have the same size as that of the metal plate. In this case, although the distances D2 and D1 are equal to each other, it is only necessary to provide notches for the metal plate 108.

According to the above-described first embodiment, providing notches for the metal plate can suppress undesired current outside the notches from the viewpoint of the antenna, and adjusting the positions and depth of the notches can improve the antenna characteristics to a desired level.

(Second Embodiment)

A wireless apparatus according to the second embodiment will be described with reference to FIGS. 9A and 9B.

Figure 9A:
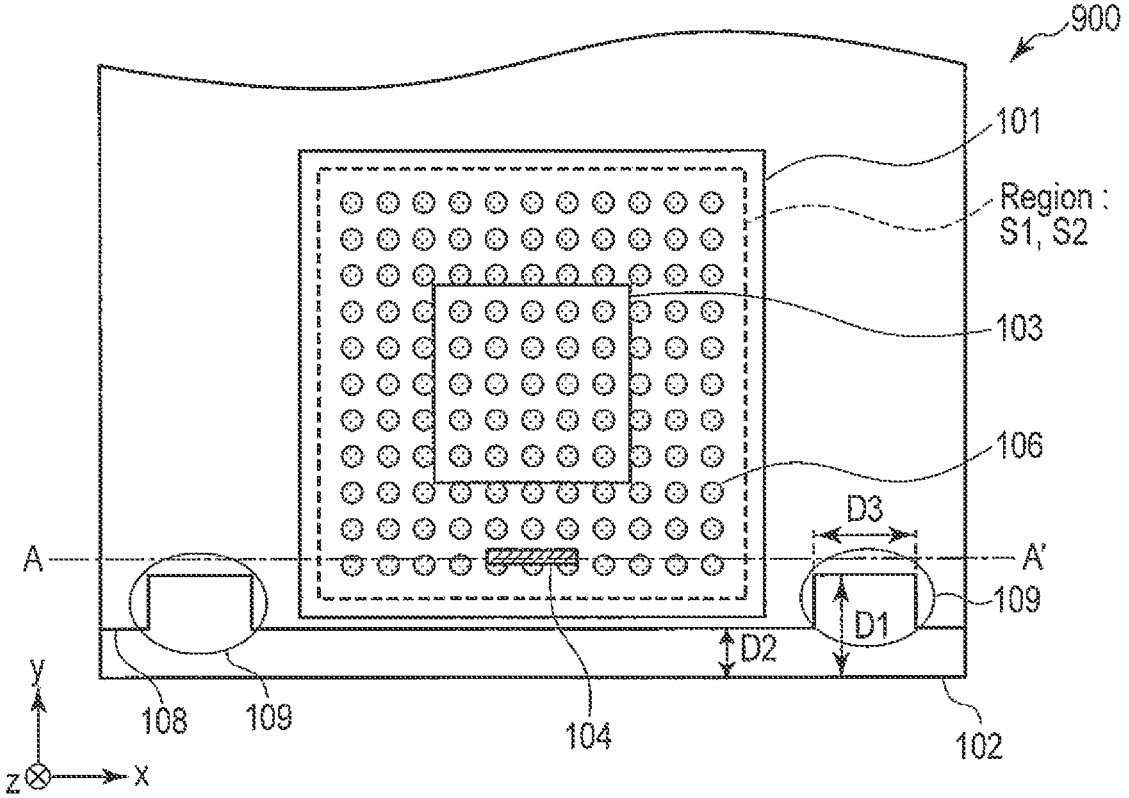
FIG. 9A is a plan view illustrating a wireless apparatus according to the second embodiment.
Figure 9B:
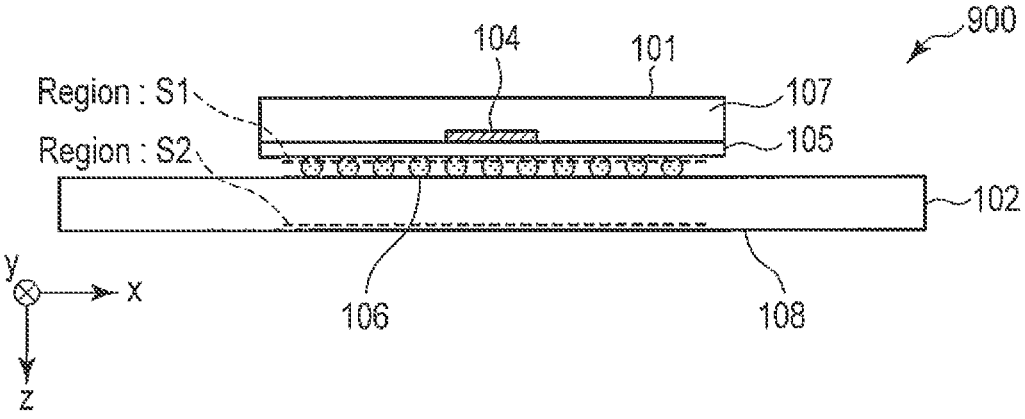
FIG. 9B is a sectional view illustrating the wireless apparatus according to the second embodiment.

FIG. 9A is a plan view illustrating a wireless apparatus when seen from the z-axis direction. FIG. 9B is a sectional view taken along a line A-A' in FIG. 9A and illustrating the wireless apparatus when seen from the y-axis direction.

A wireless apparatus 900 according to the second embodiment has almost the same arrangement as that of the wireless apparatus 100 according to the first embodiment. A different point is that a metal plate 108 has notches having a predetermined width (which is to also be referred to as a third edge, and is a distance D3 in FIG. 9A) midway along its one edge. This widens regions of the metal plate 108 outside the notches, thereby improving the degree of freedom of metal plate formation. If, for example, the metal plate is used as a ground, it is possible to widen the area of the ground and to enhance the ground.

Figure 10:
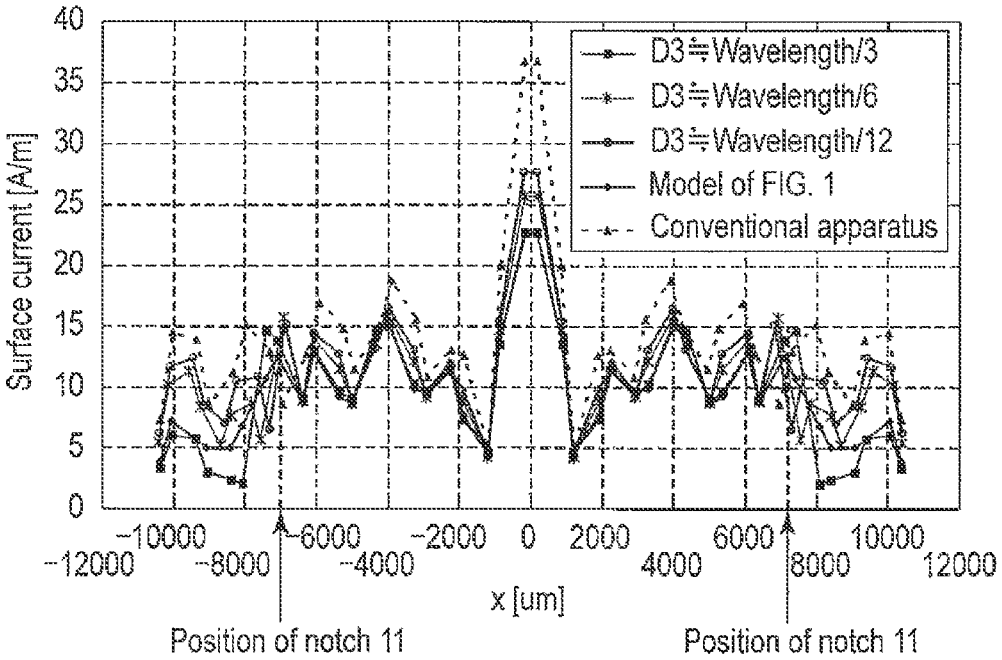
FIG. 10 is a graph illustrating a comparison of currents induced in a metal plate, which are obtained by changing the width of notches.

FIG. 10 illustrates the electromagnetic field simulation results of the intensity of the current induced on the outermost edge of the metal plate 108, which are obtained by changing the width D3 of the notches. Note that FIG. 10 also illustrates the electromagnetic field simulation result of the current intensity of the conventional apparatus for comparison, similarly to FIG. 5.

As shown in FIG. 10, if the width D3 is a 1/12 wavelength, the current induced in the metal plate 108 outside the notches from the viewpoint of an antenna 104 (at a position of 7000 μm or larger and a position of −7000 μm or smaller which are indicated by arrows in FIG. 10) are suppressed as compared with the conventional apparatus 200.

If the width D3 is a 1/6 or 1/3 wavelength, a decrease in current is larger. Making the width D3 a 1/12 wavelength or longer can suppress the current induced in the metal plate 108 outside the notches, thereby further improving the antenna characteristics.

According to the above-described second embodiment, when notches having a predetermined width (a distance D3 in FIG. 9A) are formed midway along one edge of the metal plate, regions of the metal plate outside the notches widen, thereby enabling to suppress undesired current to improve the antenna characteristics while improving the degree of freedom of metal plate formation.

(Third Embodiment)

Figure 11:
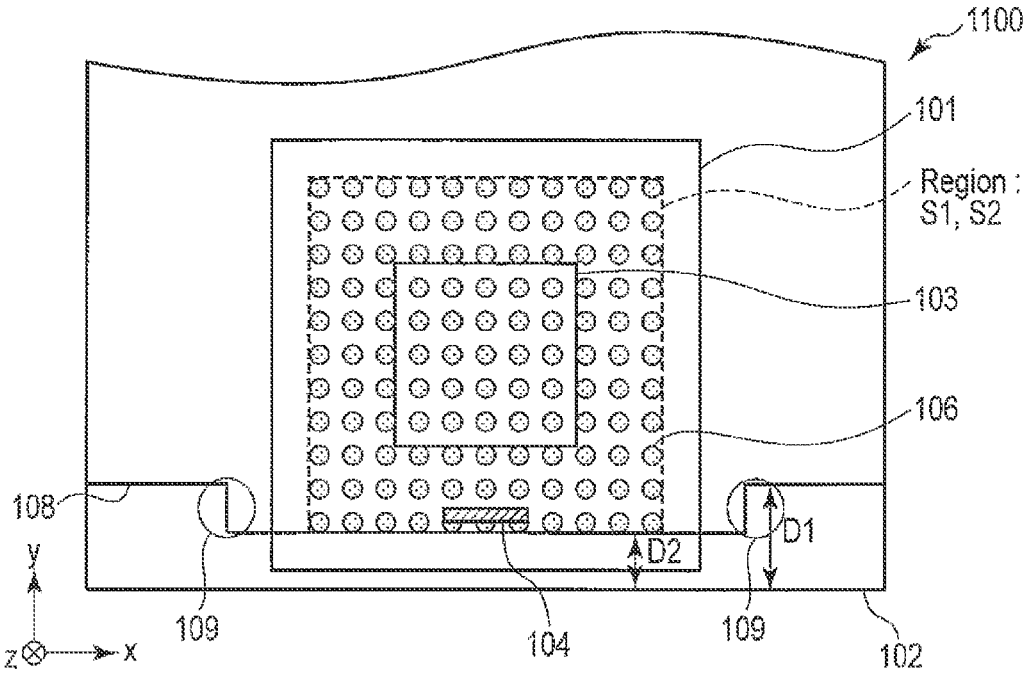
FIG. 11 is a view illustrating a wireless apparatus according to the third embodiment.

A wireless apparatus according to the third embodiment will be described with reference to FIG. 11. FIG. 11 is a plan view illustrating a wireless apparatus when seen from the z-axis direction.

A wireless apparatus 1100 according to the third embodiment has almost the same arrangement as that of the wireless apparatus 100 according to the first embodiment. A different point is that a first region is formed by a smallest region occupied by package terminals 106 and a second edge 111 of a metal plate 108 is in contact with a second region when seen from the z-axis direction. A further different point is that a portion of semiconductor package 101, which is closer to the outermost edge 110 of a mounting board 102 than the first region, is arranged closer to the outermost edge 110 of the mounting board 102 than the second edge 111 of the metal plate 108 when seen from the z-axis direction. The smallest region includes, among the package terminals 106, outermost package terminals 106 and package terminals inside the outermost package terminals 106 when seen from the z-axis direction. Note that an edge of the smallest region including all package terminals 106 overlaps the second edge 111 when seen from the z axis direction.

This arrangement enables to minimize an overlapping region between a semiconductor package 101 and the metal plate 108 when the package terminals 106 are connected to the metal plate 108 of the mounting board 102 by vias (not shown) with a shortest path without routing wiring lines. Since this reduces the size of the metal plate around an antenna 104 arranged closer to the outermost edge 110 of the mounting board 102 than the center of the semiconductor package 101, it is possible to decrease an influence exerted by the metal plate 108 on the antenna 104.

According to the above-described third embodiment, if components and other metal plates are not arranged between the semiconductor package 101 and the outermost edge 110 of the mounting board 102, there are no components and other metal plates between the antenna 104 and the outermost edge 110 of the mounting board 102, and therefore, the antenna characteristics improve. Furthermore, since there is no obstacle between the antenna 104 and the mounting board 102, the antenna 104 can efficiently radiate to the outside.

(Fourth Embodiment)

Figure 12A:
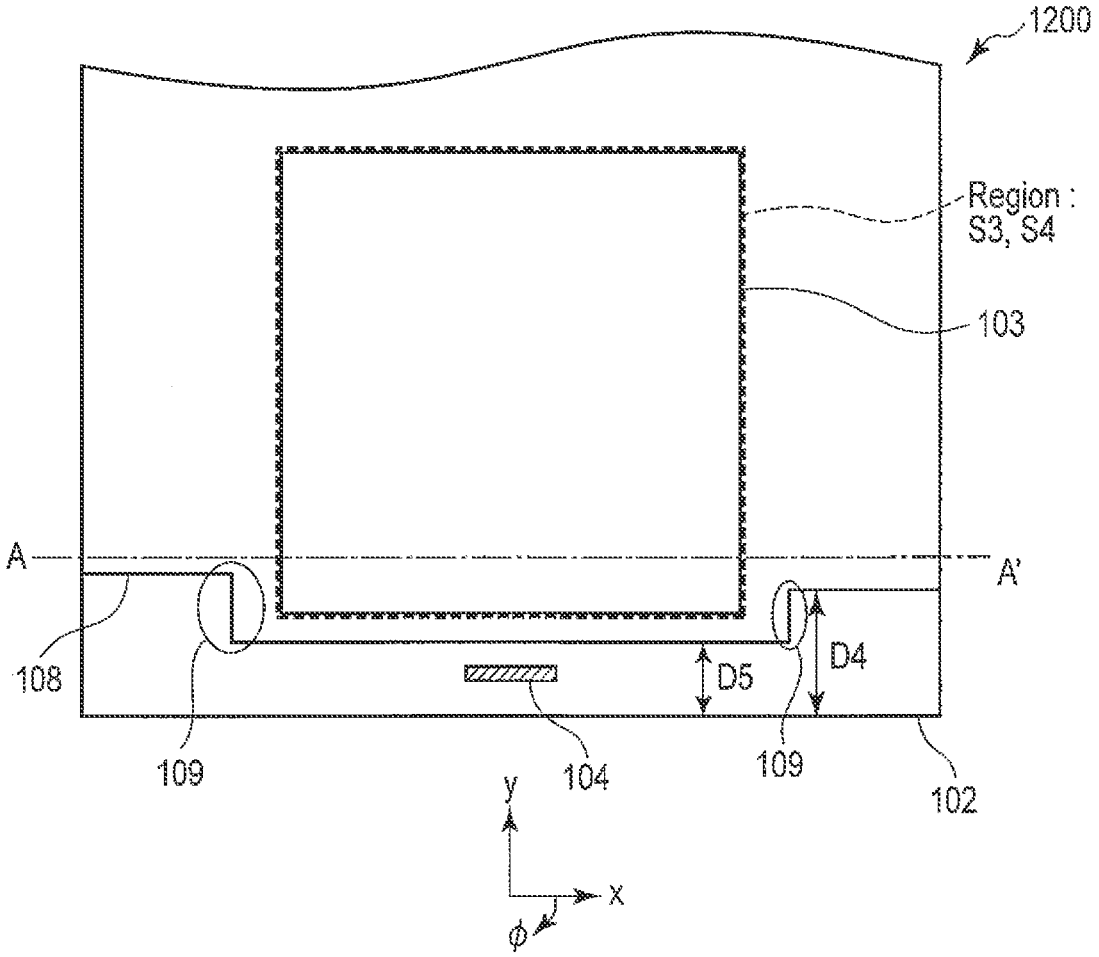
FIG. 12A is a plan view illustrating a wireless apparatus according to the fourth embodiment.
Figure 12B:
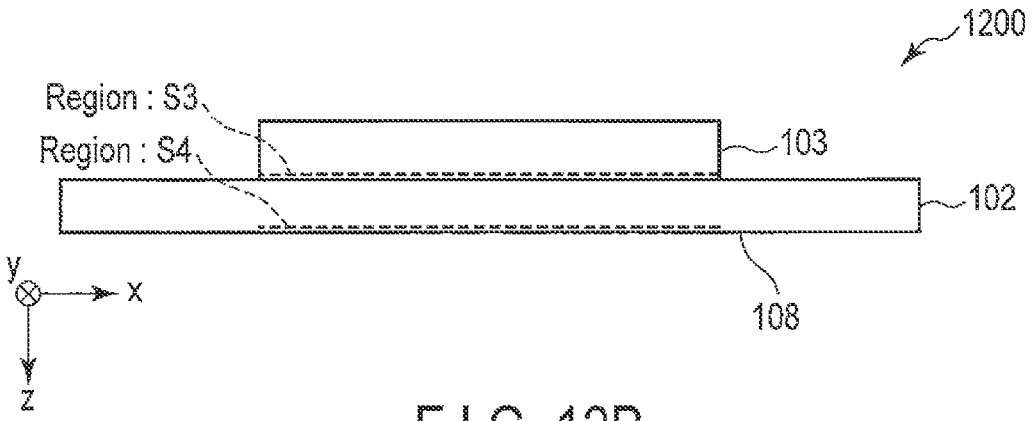
FIG. 12B is a sectional view illustrating the wireless apparatus according to the fourth embodiment.

A wireless apparatus according to the fourth embodiment will be described with reference to FIGS. 12A and 12B. FIG. 12A is a plan view illustrating a wireless apparatus when seen from the z-axis direction. FIG. 12B is a sectional view taken along a line A-A' in FIG. 12A and illustrating the wireless apparatus when seen from the y-axis direction.

A wireless apparatus 1200 according to the fourth embodiment includes a semiconductor chip 103, a mounting board 102, an antenna 104, and a metal plate 108. A different point from the wireless apparatus 100 according to the first embodiment is that the semiconductor chip 103 and the mounting board 102 are directly connected with each other without using the semiconductor package 101 (so-called bear chip implementation).

The antenna 104 may be formed by a metal plate on the semiconductor chip 103 or mounting board 102, or may be made of a combination of a metal plate on the semiconductor chip 103 or mounting board 102 and a boding wire, bump, dielectric board (not shown), or the like. As shown in FIG. 12A, in this example, the antenna 104 is formed by a metal plate on the mounting board 102, and is arranged closer to an outermost edge 110 of the mounting board 102 than the center of the semiconductor chip 103.

The metal plate 108 is formed to include a fourth region obtained by projecting a third region occupied by the semiconductor chip 103 in the thickness direction of the mounting board 102. Furthermore, the metal plate 108 has notches 109, similarly to the first embodiment.

According to the above-described fourth embodiment, similarly to the first embodiment, it is possible to improve the antenna characteristics to a desired level by suppressing undesired current. Furthermore, bear chip implementation can reduce the circuit scale.

(Fifth Embodiment)

It is also possible to use the above-described wireless apparatus for a wireless system. An example of a wireless system including the wireless apparatus according to one of the first to fourth embodiments will be described with reference to FIG. 13.

The wireless system is a system for exchanging data, images, and moving images and includes the above-described wireless apparatus.

Figure 13:
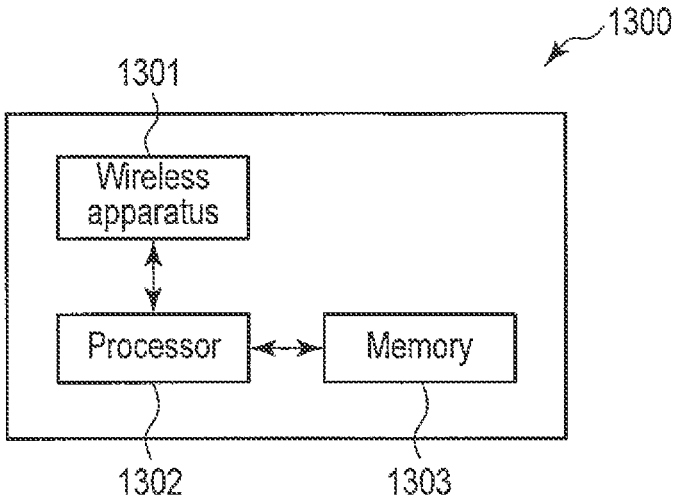
FIG. 13 is a block diagram illustrating a wireless system including a wireless apparatus.

A wireless system according to the fifth embodiment will be described with reference to a block diagram illustrated in FIG. 13. A wireless system 1300 illustrated in FIG. 13 includes a wireless apparatus 1301, a processor 1302, and a memory 1303.

The wireless apparatus 1301 externally transmits and receives data. Note that the wireless apparatus (a wireless apparatus 100, 600, 700, 800, 900, 1100, or 1200) according to any of the first to fourth embodiments may be used.

The processor 1302 processes data received from the wireless apparatus 1301 or data to be transmitted to the wireless apparatus 1301.

The memory 1303 receives data from the processor 1302 and stores the data.

An example of the wireless system incorporating the wireless apparatus will be described with reference to FIG. 14.

The wireless system is, for example, a note PC 1401 and portable terminal 1402. The note PC 1401 and portable terminal 1402 internally or externally includes the wireless apparatus, and makes data communication via the wireless apparatus using, for example, a millimeter-wave frequency band. Although the note PC 1401 and portable terminal 1402 include the wireless apparatus 100 in this example, any of the above-described wireless apparatuses may be included.

The wireless apparatus of the note PC 1401 and that of the portable terminal 1402 can efficiently exchange data when they are arranged so that the directions in which their antennas 104 have a high directivity oppose each other.

Figure 14:
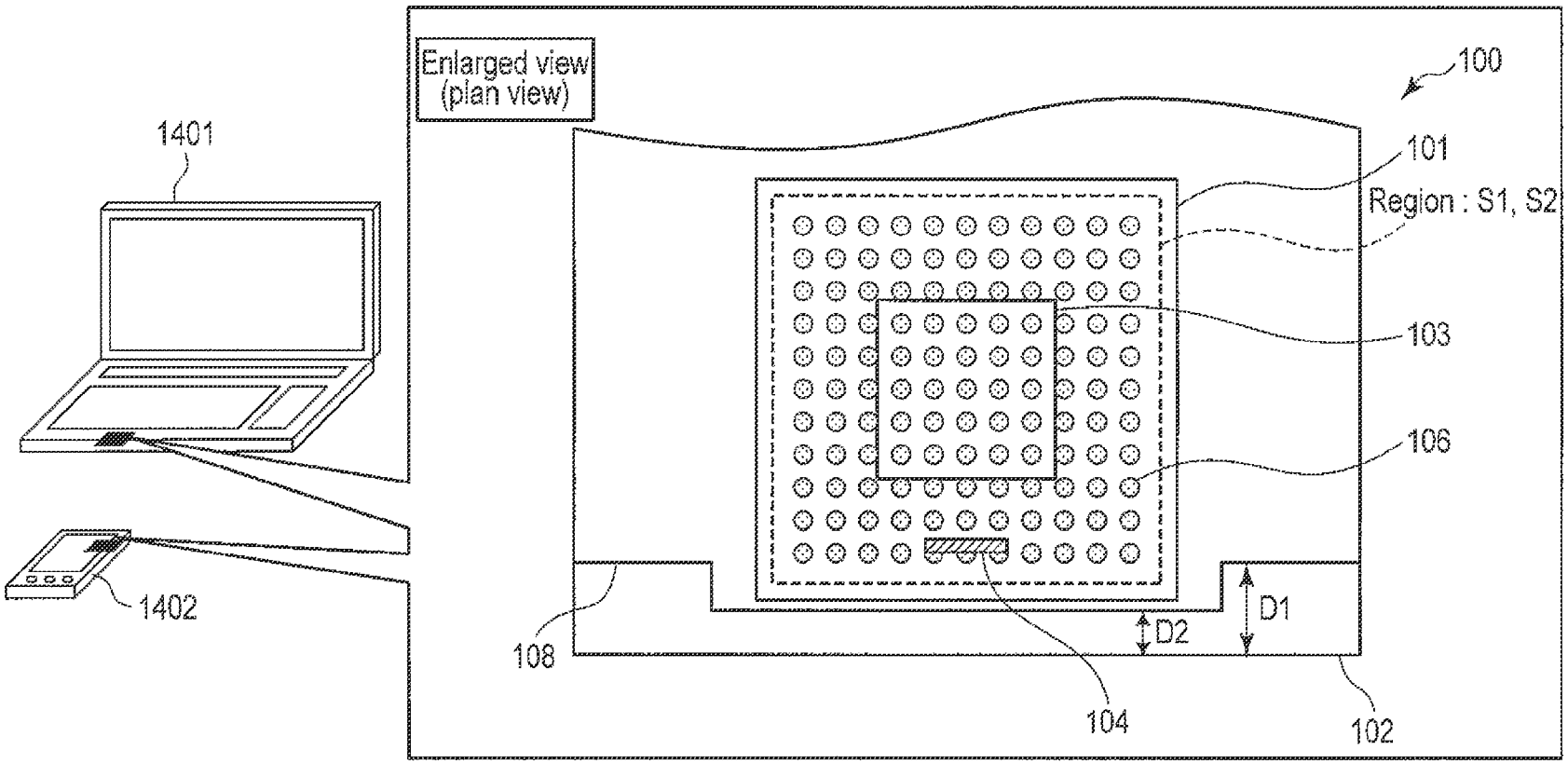
FIG. 14 is a view illustrating an example of the wireless system including the wireless apparatus.

Although the note PC 1401 and portable terminal 1402 are illustrated in the example of FIG. 14, the present embodiment is not limited to them. The wireless apparatus may be included in other systems such as a TV, digital camera, and memory card.

Figure 15:
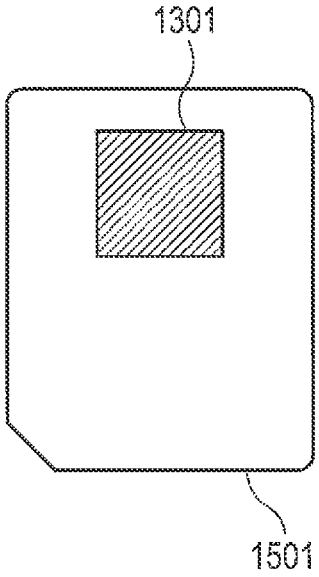
FIG. 15 is a view illustrating a case in which a memory card incorporates a wireless apparatus.

FIG. 15 illustrates a case in which a memory card mounted on the wireless apparatus.

As illustrated in FIG. 15, a memory card 1501 includes the wireless apparatus 1301, and can make wireless communication with a note PC, a portable terminal, a digital camera, or the like via the wireless apparatus 1301. Note that the wireless apparatus included in the memory card 1501 is desirably the wireless apparatus 1200 obtained by bear chip implementation as shown in FIGS. 12A and 12B in terms of the circuit scale. Any of the above-described wireless apparatuses, however, may be used.

According to the above-described fifth embodiment, by incorporating a wireless apparatus in a wireless system for wirelessly communicating data, such as a note PC and portable terminal, it is possible to efficiently transmit and receive data and the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A wireless apparatus, comprising:

a mounting board having a first surface and a second surface opposite to the first surface;

a semiconductor package including at least one antenna and being mounted on the first surface; and a first layer being a conductor formed on the second surface or between the first surface and the second surface, being different from the antenna, and overlapping with at least the semiconductor package and the antenna when seen in a thickness direction of the mounting board, a size of the first layer being larger than the semiconductor package and the antenna, wherein when seen in the thickness direction of the mounting board, at least one portion of an edge of the first layer is concaved, and the antenna is arranged closer to the edge of the first layer than a center of the first layer.

2. The apparatus according to claim 1, wherein the semiconductor package further includes terminals and a first region occupied by all of the terminals, and wherein the first layer is concaved at a portion of the edge outside a second region, the second region being obtained by projecting the first region in the thickness direction of the mounting board.

3. The apparatus according to claim 1, wherein the mounting board and the first layer are substantially polygonal, wherein the antenna is arranged closer to a first edge of the first layer than the center of the first layer when seen in the thickness direction of the mounting board, the concaved portion of the first edge is a notch formed by a first distance, the first distance being a distance between a second edge and a third edge, the second edge and the third edge being portions of the first edge and being parallel to an outermost edge of the mounting board which is closest to the first edge, and wherein a second distance between the second edge and the outermost edge is shorter than a third distance between the third edge and the outermost edge.

4. The apparatus according to claim 3, wherein the first distance is not less than a 1/12 wavelength.

5. The apparatus according to claim 3, wherein a length of the third edge is not less than a 1/12 wavelength.

6. The apparatus according to claim 3, wherein when seen in the thickness direction of the mounting board, the semiconductor package is arranged so that a partial region of the semiconductor package is closer to the outermost edge than the second edge, the partial region being a region closer to the outermost edge of the board than a first region, the first region being occupied by the terminals.

7. The apparatus according to claim 6, wherein when seen in the thickness direction of the mounting board, an edge of a smallest region being occupied by all the terminals overlaps the second edge.

8. The apparatus according to claim 6, wherein no component and conductor is arranged between the outermost edge of the mounting board and the semiconductor package.

9. The apparatus according to claim 1, wherein the concaved portion exists, on the first layer, at both sides of the antenna when seen in the thickness direction of the mounting board.

10. A wireless apparatus, comprising:

at least one semiconductor chip;

at least one antenna connected with the semiconductor chip;

a mounting board having a first surface and a second surface opposite to the first surface, the semiconductor chip being mounted on the first surface; and a first layer being a conductor formed on the second surface or between the first surface and the second surface, being different from the antenna, and overlapping with at least the semiconductor package and the antenna when seen in a thickness direction of the mounting board, a size of the first layer being larger than the semiconductor package and the antenna, wherein when seen in the thickness direction of the mounting board, at least one portion of an edge of the first layer is concaved and the at least one antenna is arranged closer to the edge of the first layer than a center of the first layer.

11. The apparatus according to claim 10, wherein the first layer is concaved at a portion of the edge outside a second region, the second region being obtained by projecting the semiconductor chip in the thickness direction of the board.

12. The apparatus according to claim 10, wherein the mounting board and the first layer are substantially polygonal, wherein the at least one antenna is arranged closer to a first edge of the first layer than the center of the first layer when seen in the thickness direction of the mounting board, the concaved portion of the first edge is a notch formed by a first distance, the first distance being a distance between a second edge and a third edge, the second edge and the third edge being portions of the first edge and being parallel to an outermost edge of the mounting board which is closest to the first edge, and wherein a second distance between the second edge and the outermost edge is shorter than a third distance between the third edge and the outermost edge.

13. The apparatus according to claim 12, wherein the first distance is not less than a 1/12 wavelength.

14. The apparatus according to claim 12, wherein a length of the third edge is not less than a 1/12 wavelength.

15. The apparatus according to claim 12, wherein no component and conductor is arranged between the outermost edge of the board and the semiconductor chip other than the antenna.

16. The apparatus according to claim 10, wherein the concaved portion exists, on the first layer, at both sides of the antenna when seen in the thickness direction of the mounting board.

* * * * *